US009316054B2

(12) United States Patent
Weinstock et al.

(10) Patent No.: US 9,316,054 B2
(45) Date of Patent: Apr. 19, 2016

(54) SYSTEMS AND METHODS FOR MANAGING PRESSURE IN A WELLBORE

(71) Applicants: Charles W. Weinstock, The Woodlands, TX (US); Mingqin Duan, Katy, TX (US)

(72) Inventors: Charles W. Weinstock, The Woodlands, TX (US); Mingqin Duan, Katy, TX (US)

(73) Assignee: Chevron U.S.A. Inc., San Ramon, CA (US)

( * ) Notice: Subject to any disclaimer, the term of this patent is extended or adjusted under 35 U.S.C. 154(b) by 0 days.

(21) Appl. No.: 13/766,959

(22) Filed: Feb. 14, 2013

(65) Prior Publication Data

US 2013/0206423 A1 Aug. 15, 2013

Related U.S. Application Data

(60) Provisional application No. 61/598,428, filed on Feb. 14, 2012.

(51) Int. Cl.

| | |
|---|---|
| ***E21B 43/01*** | (2006.01) |
| ***E21B 7/12*** | (2006.01) |
| ***E21B 43/30*** | (2006.01) |

(Continued)

(52) U.S. Cl.

CPC . *E21B 7/12* (2013.01); *E21B 21/08* (2013.01); *E21B 43/305* (2013.01); *E21B 2021/006* (2013.01)

(58) Field of Classification Search

CPC ..... E21B 21/08; E21B 21/10; E21B 21/103; E21B 21/12; E21B 21/001; E21B 21/002; E21B 21/003

USPC ..... 166/351, 358, 368, 90.1; 175/5, 207, 175/217

See application file for complete search history.

(56) References Cited

U.S. PATENT DOCUMENTS

| | | | |
|---|---|---|---|
| 3,855,656 | A | 12/1974 | Blenkarn |
| 3,981,360 | A | 9/1976 | Marathe |

(Continued)

FOREIGN PATENT DOCUMENTS

| | | |
|---|---|---|
| WO | 86/05231 | 9/1986 |
| WO | 2007/139581 | 12/2007 |

(Continued)

OTHER PUBLICATIONS

International Search Report for PCT.US11/053586 dated Jun. 19, 2012, 6 pages.

(Continued)

*Primary Examiner* — Matthew R Buck
*Assistant Examiner* — Patrick Lambe
(74) *Attorney, Agent, or Firm* — Karen R. DiDomenicis; John E. Vick

(57) ABSTRACT

A method for drilling a subsea well from a rig through a subsea wellhead below the rig includes employing a single gradient or dual gradient drilling system that includes a drill string that extends from the rig into the well and surface mud pumps for pumping drilling fluid through the drill string and into a well annulus of the well. The drilling system includes a subsea rotating device for conducting the drilling fluid from the well annulus and through a solids processing unit. A subsea pump then conducts the drilling fluid from the solids processing unit to a return line back to the rig. The surface mud pump and subsea pump are staged in coordination to trap pressure and/or remove pressure in the well annulus to maintain a selected pressure gradient in the well annulus.

16 Claims, 7 Drawing Sheets

(51) Int. Cl.
*E21B 21/08* (2006.01)
*E21B 21/00* (2006.01)

(56) References Cited

U.S. PATENT DOCUMENTS

| | | | | |
|---|---|---|---|---|
| 4,059,148 | A | 11/1977 | Blomsma | |
| 4,099,560 | A | 7/1978 | Fischer et al. | |
| 4,176,986 | A | 12/1979 | Taft et al. | |
| 4,210,208 | A | 7/1980 | Shanks | |
| 4,291,772 | A | 9/1981 | Beynet | |
| 4,366,928 | A | 1/1983 | Hughes | |
| 4,373,592 | A | 2/1983 | Dellinger et al. | |
| 4,621,655 | A | 11/1986 | Roche | |
| 4,626,135 | A | 12/1986 | Roche | |
| 4,719,937 | A | 1/1988 | Roche et al. | |
| 4,813,495 | A | 3/1989 | Leach | |
| 4,832,126 | A | 5/1989 | Roche | |
| 4,892,258 | A | 1/1990 | Hughes | |
| 5,826,658 | A | 10/1998 | Harthorn et al. | |
| 6,102,673 | A | 8/2000 | Mort et al. | |
| 6,123,151 | A | 9/2000 | Regan et al. | |
| 6,216,799 | B1 | 4/2001 | Gonzalez | |
| 6,230,824 | B1 | 5/2001 | Peterman et al. | |
| 6,263,981 | B1 | 7/2001 | Gonzalez | |
| 6,276,455 | B1 * | 8/2001 | Gonzalez | 166/357 |
| 6,325,159 | B1 | 12/2001 | Peterman et al. | |
| 6,328,107 | B1 | 12/2001 | Maus | |
| 6,394,195 | B1 | 5/2002 | Shubert et al. | |
| 6,415,877 | B1 | 7/2002 | Fincher et al. | |
| 6,450,262 | B1 | 9/2002 | Regan | |
| 6,470,975 | B1 | 10/2002 | Bourgoyne et al. | |
| 6,474,422 | B2 | 11/2002 | Schubert et al. | |
| 6,527,054 | B1 | 3/2003 | Fincher et al. | |
| 6,530,437 | B2 | 3/2003 | Maurer et al. | |
| 6,571,873 | B2 | 6/2003 | Maus | |
| 6,648,081 | B2 | 11/2003 | Fincher et al. | |
| 6,668,943 | B1 | 12/2003 | Maus et al. | |
| 6,745,857 | B2 | 6/2004 | Gjedebo | |
| 6,802,379 | B2 | 10/2004 | Dawson et al. | |
| 6,854,532 | B2 | 2/2005 | Fincher et al. | |
| 6,926,101 | B2 | 8/2005 | deBoer | |
| 7,027,968 | B2 | 4/2006 | Choe et al. | |
| 7,114,581 | B2 | 10/2006 | Aronstann et al. | |
| 7,134,498 | B2 | 11/2006 | Hopper | |
| 7,159,669 | B2 | 1/2007 | Bourgoyne et al. | |
| 7,270,185 | B2 | 9/2007 | Fontana et al. | |
| 7,490,672 | B2 | 2/2009 | Hollier | |
| 8,210,264 | B2 | 7/2012 | Mohr | |
| 8,746,348 | B2 | 6/2014 | Reed | |
| 8,783,359 | B2 | 7/2014 | Reed | |
| 2002/0108782 | A1 | 8/2002 | Boer | |
| 2003/0070840 | A1 | 4/2003 | de Boer | |
| 2004/0031623 | A1 | 2/2004 | Fontana | |
| 2004/0065440 | A1 | 4/2004 | Farabee et al. | |
| 2007/0095540 | A1 | 5/2007 | Kozicz et al. | |
| 2008/0105434 | A1 | 5/2008 | Orbell et al. | |
| 2008/0302570 | A1 | 12/2008 | deBoer | |
| 2009/0314544 | A1 | 12/2009 | Humphreys | |
| 2010/0147593 | A1 | 6/2010 | Hariharan et al. | |

FOREIGN PATENT DOCUMENTS

| | | |
|---|---|---|
| WO | 2008/151128 | 12/2008 |
| WO | 2010/069992 | 6/2010 |

OTHER PUBLICATIONS

Eggemeyer, J.C. et al., SPE 71359; "Subsea Mudlift Drilling: Design and Implementation of a Dual Gradient Drilling System", Society of Petroleum Engineers Inc, 2001, 13 pages.

Smith, K.L. et al., SPE 71357; "Subsea Mudlift Drilling Joint Industry Project; Delivering Dual Gradient Drilling Technology to Industry", Society of Petroleum Engineers Inc, 2001, 13 pages.

* cited by examiner

SYSTEMS AND METHODS FOR MANAGING PRESSURE IN A WELLBORE

CROSS-REFERENCE TO RELATED APPLICATION

This application claims priority to U.S. Provisional Application No. 61/598,428, entitled "Apparatus, System And Method For Managing Pressure In A Wellbore," filed on Feb. 14, 2012. The complete disclosure of the above-identified application is hereby fully incorporated herein by reference.

TECHNICAL FIELD

The present application relates generally to equipment utilized and operations performed in conjunction with hydrocarbon-producing wells beneath a body of water. More particularly, the present application relates to the management of pressure in the well.

BACKGROUND

A floating drilling unit or drilling rig on a fixed platform may be used to drill a well beneath water. A floating drilling unit typically is used in deep water areas while a fixed platform rig commonly is used in shallow water areas. In deep water drilling applications in which a floating vessel is employed, the vessel may be moored to the sea floor or may be kept in place with a dynamic positioning system. A marine riser consisting of multiple joints of large diameter steel pipe connected in series may be deployed from the vessel to a wellhead located at the sea floor.

In conventional drilling operations, the riser provides a conduit to return drilled earth cuttings from the well being drilled to the vessel, and to guide drilling tools from the floating vessel to the well. The primary drilling tools are a rotating drill bit that makes the hole and a drill string that conveys drill bit into the hole (wellbore) from the floating vessel. The drill string is essentially multiple joints of hollow steel pipe connected together that allows fluid flowing through it. It has a much smaller diameter than a marine riser, typically 3½ to 6⅝ inches in outer diameter. To cut the hole, the drill bit is either rotated by the drill string that is driven by a drilling machine at the vessel, or is rotated by a motor downhole in the drill string.

A fluid with predetermined density, called "drilling fluid" or "mud", is injected down the drill string and out of the drill bit at the bottom of the hole. The mud carries earth cuttings from the bit upwards in the annular space between the drill string and the sides of the wellbore. Mud returns these cuttings to the vessel at the surface through the annulus between the drill string and the marine riser.

In conventional drilling, the wellbore is occupied by the drill string and a full column of mud from the surface all the way downwards to the bottom hole. The density of the mud must be designed in such a way that the hydrostatic pressure from the mud column is high enough to counter-balance the fluid pressure from the formation, referred to as "pore pressure". Otherwise, formation fluids, typically hydrocarbons or water, will enter the well, and a discharge of formation fluids out of the well will occur. An uncontrolled discharge is known as a blowout that must be avoided. At the same time, the mud hydrostatic pressure in the wellbore must not exceed the rock strength, referred to as "fracture pressure". Otherwise, if fracture pressure is exceeded, the formation surrounding the wellbore can be fractured. If fracturing occurs, the wellbore losses integrity and mud will flow out of the wellbore into the formation instead of returning back to surface, which is known as "lost returns" or "lost circulation". In other words, wellbore pressure from the weight of mud column must stay within the operating window between formation pore pressure and fracture pressure at all times during drilling operations.

A principal challenge in deepwater drilling is to keep the wellbore pressure within the operating window long enough so that the potential hydrocarbon-filled pay zone may be reached. As the well deepens, the wellbore pressure will eventually be taken out of the required operating pressure window. A series of steel tubes called "casing" must be installed to reinforce the upper portions of the hole before drilling can continue with a smaller drill bit through the upper casing stings. As a result, the well diameter becomes progressively smaller as the well becomes deeper. The largest casing set immediately below sea floor is typically limited to 36 inches in diameter. The well must be able to reach the pay zone before it is required to run the smallest-size casing. Therefore, it is required to safely drill a hole section without casing (called "open hole") for as long as possible.

As oil companies drill further offshore, large hydrocarbon deposits may be encountered. Pore pressure and fracture pressure are largely dependent upon the mass of the formations and seawater above that specific formation of interest. As water becomes deeper, however, the drilling operating pressure window between pore pressure and fracture pressure becomes narrower due to the higher percentage of seawater weight and lower percentage of rock weight above a zone. This narrow window can prevent drilling to the desired target depth. The challenge is even greater when a horizontal well is required. A horizontal well is known to increase oil and gas production by two to five times than a vertical straight well. Thus, it is highly desirable to drill horizontal wells.

The common practice in horizontal drilling is to line the wellbore walls of all the upper sections with casing strings before penetrating pay zones horizontally or near horizontally. Once the lateral hole is opened, no more casing can be installed before the lateral section is finished. The length of the lateral section through the pay zones must be long enough to achieve the desired production rate. The conventional drilling technology may be able to achieve the desired lateral length in a land well or a shallow water well where the operating window is wide enough. It typically does not work nearly as well in deep waters where the window is narrow.

Therefore, a need exists for a drilling system that can manage pressure so as to increase lateral, pay-zone wellbore length while staying below the fracture pressure.

SUMMARY

The present application is directed to systems for drilling a horizontal or a near-horizontal well offshore using a subsea mud pump and other subsea drilling devices to increase the length of a wellbore section that may be drilled, thereby facilitating greater oil and gas production. The present application is also directed to methods of implementing such systems.

In one aspect of the invention, a method for drilling a subsea well from a rig through a subsea wellhead below the rig includes employing a drilling system having one or more surface pumps, a subsea rotating device, a solids processing unit, a subsea pump, such as a mudlift pump, and a return line. The surface pump(s) are staged in coordination with the subsea pump such that the subsea pump removes a portion of pressure in the well annulus, whereby the pressure gradient in the well annulus after removing the pressure is above ambient seawater gradient. In certain aspects, the surface pump(s) are staged in coordination with the subsea pump such that a pressure is trapped in the well annulus during static intervals before the subsea pump removes the pressure in the well annulus during dynamic intervals.

In another aspect of the invention, a method for drilling a subsea well from a rig through a subsea wellhead below the rig includes employing a drilling system having one or more surface pumps, a solids processing unit, a subsea pump, and a return line. The surface pump(s) are staged in coordination with the subsea pump such that the subsea pump removes a portion of pressure in the well annulus, whereby the pressure gradient in the well annulus after removing the pressure is above ambient seawater gradient. In certain aspects, the surface pump(s) are staged in coordination with the subsea pump such that a pressure is trapped in the well annulus during static intervals before the subsea pump removes the pressure in the well annulus during dynamic intervals.

The features of the present invention will be readily apparent to those skilled in the art upon a reading of the description of the preferred embodiments that follows.

BRIEF DESCRIPTION OF THE DRAWINGS

For a more complete understanding of the exemplary embodiments of the present invention and the advantages thereof, reference is now made to the following description in conjunction with the accompanying drawings, which are briefly described as follows.

DETAILED DESCRIPTION

Figure 1:
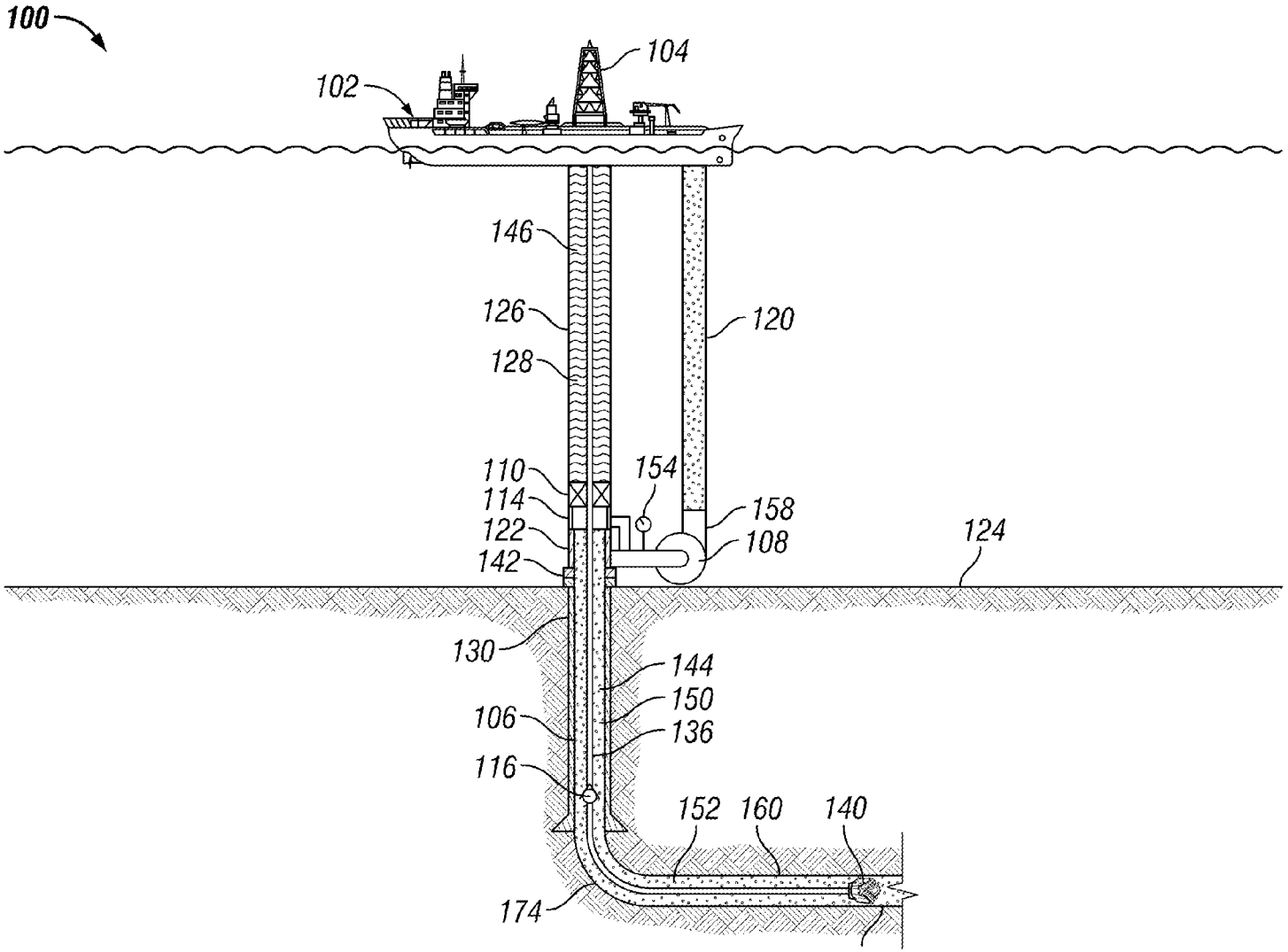
FIG. 1 is a schematic of a dual gradient drilling system, according to an exemplary embodiment.

Illustrative embodiments of the invention are described below. In the interest of clarity, not all features of an actual implementation are described in this specification. One of ordinary skill in the art will appreciate that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The present invention may be better understood by reading the following description of non-limitative embodiments with reference to the attached drawings wherein like parts of each of the figures are identified by the same reference characters. The words and phrases used herein should be understood and interpreted to have a meaning consistent with the understanding of those words and phrases by those skilled in the relevant art. No special definition of a term or phrase, for example, a definition that is different from the ordinary and customary meaning as understood by those skilled in the art, is intended to be implied by consistent usage of the term or phrase herein. To the extent that a term or phrase is intended to have a special meaning, for example, a meaning other than that understood by skilled artisans, such a special definition will be expressly set forth in the specification in a definitional manner that directly and unequivocally provides the special definition for the term or phrase. Moreover, various conditions and positions may be referred to with terms such as "higher," "lower," "top," "bottom," "lighter," "heavier," "front," "rear," etc., or other like terminology. Those skilled in the art will recognize that such terms reflect conditions relative to another condition, not an absolute measurement of any particular state.

The present application is directed to systems for drilling a horizontal or a near-horizontal well offshore using a subsea mud pump and other subsea drilling devices to increase the length of a wellbore section that may be drilled, thereby facilitating greater oil and gas production. The present application is also directed to methods of implementing such systems.

Referring now to FIG. 1, a drilling system 100 is illustrated for managing pressure in a dual gradient drilling configuration for extended-reach or long horizontal well drilling, according to an exemplary embodiment. The illustrations in FIG. 1 are not intended to be physically or dimensionally correct, but are utilized to illustrate the concepts of the present invention. Generally, the drilling system 100 includes a floating drilling vessel 102 equipped with a drilling rig 104 for drilling a wellbore 106, a subsea pump 108, a subsea rotating device 110, a solids processing unit 114, a drill string valve 116, and a mud return line 120. In certain exemplary embodiments, the drilling vessel 102 is a drill ship, or a floating platform, such as a semi-submersible. The drilling rig 104 may be equipped with a subsea wellhead stack 122 located at a sea bottom or floor 124 and a low pressure marine riser 126 connecting the wellhead stack 122 with the floating vessel 102. A riser annular space 128 is defined between the riser 126 and a hollow drill string, or drill pipe 136. In certain exemplary embodiments, the wellhead stack 122 may include a series of blowout preventers (not shown) to close and seal the wellbore 106 at the sea floor 124 to prevent formation fluid releases from the wellbore 106. In certain exemplary embodiments, a portion of the wellbore 106 includes a casing 130 to prevent the wall of the wellbore 106 from caving in, to prevent movement of fluids from one formation to another, and to improve the efficiency of extracting hydrocarbons if the well is productive. The number of casings 130 to seal off the upper portion of the wellbore 106 prior to the start of a horizontal section may be greater than as shown in FIG. 1.

Generally, drilling fluids, such as drilling mud 144, are pumped using surface mud pumps (not shown) from mud tanks (not shown) at the drilling vessel 102 down the hollow drill string 136 in the wellbore 106. In certain exemplary embodiments, as many as three surface mud pumps are utilized. The drilling fluids exit a drill bit 140 and return to a well head 142 at the sea floor 124 through a casing annular space 150 and/or wellbore annular space 152. The casing annular space 150 is the space defined by the outer diameter of the drill string 136 and inner diameter of the casing 130. The wellbore annular space 152 is the space defined by the outer diameter of the drill string 136 and inner diameter of the wellbore 106. In certain exemplary embodiments, the drilling fluids may carry drilled cuttings (not shown) from the drill bit 140 while moving through the annular spaces 150, 152. The mixture of drilling fluids and cuttings enters the solids processing unit 114 where any larger-sized cuttings are reduced to smaller-sized cuttings for safe pumping by the subsea pump 108. The fluids return is routed from the solids processing unit 114 to the subsea pump 108. In certain exemplary embodiments, the solids processing unit 114 is deployed above the subsea pump 108. In certain exemplary embodiments, both the subsea pump 108 and the solids processing unit 114 are deployed remote to the riser 126, either on a separate pedestal (not shown) or hanging from a secondary suspended riser (not shown). In certain exemplary embodiments, solids processing unit 114 is deployed below the subsea rotating device 110. In certain exemplary embodiments, the solids processing unit 114 is deployed around the riser 126. In certain exemplary embodiments, the solids processing unit 114 is deployed remote to the riser 126 on the sea floor 124 and connected to the annular space 150 and subsea pump 108 using umbilical hoses (not shown). In certain exemplary embodiments, the solids processing unit 114 may be deployed remote to the riser 126 on a secondary suspended riser (not shown) and connected to the annular space 150 and subsea pump 108 using umbilical hoses.

The subsea pump 108 serves to pump fluids and other returns from the wellbore 106 to the drilling vessel 102 through the mud return line 120. In certain exemplary embodiments, the subsea pump 108 is located at or near the sea floor 124. The subsea pump 108 is able to control the pressure in the wellbore 106 from the sea floor 124. The subsea pump 108 pumps the drilling fluids with entrained cuttings to mud-solids separation units (not shown) at the floating vessel 102 through the dedicated mud return line 120, rather than through the riser 126. The cuttings are removed and the drilling fluids return to the mud tanks and then pumped down the drill string 136, thus constituting a continuous circulation system.

In certain exemplary embodiments, the subsea pump 108 is a mudlift pump. The mudlift pump can be a positive displacement pump driven by filtered sea water or other types of hydraulic fluids. In certain other embodiments, the mudlift pump can be driven by electricity or large hydraulic pump units located at or near the sea floor 124. Suitable examples of subsea pumps for use in the present invention include, but are not limited to, the MaxLift 1800 mudlift pump available from GE Oil & Gas. Two or more surface pumps (not shown) on the drilling vessel 102 are used to inject sea water power fluid down a dedicated line 702 (FIG. 7) to power the subsea pump 108. In certain exemplary embodiments, the line 702 is mounted to an exterior of the riser 126. The exhaust sea water is then dumped to ambient sea water through a choke (not shown) on the subsea pump 108. The opening of this subsea sea water choke can be controlled to regulate the pressure at the inlet of the subsea pump 108. The inlet pressure is transmitted to the wellbore 106 through the annular space 150 and the solids processing unit 114. If there is a change in the subsea pump inlet pressure, there will be a same pressure change everywhere in the annular spaces 150, 152 of the wellbore 106. The wellbore 106 will not see the pump outlet pressure as the outlets 158 are not open to the wellbore 106. The outlets 158 are open to the mud return line 120. In certain exemplary embodiments, the subsea pump 108 works in pressure mode during the drilling process. In pressure mode, a constant pump inlet pressure specified by the user is maintained and closely monitored by multiple pressure transducers 154 at the subsea pump 108. When the drilling fluids injection rate from surface pumps is changed, the fluids return rate at the subsea pump adjusts accordingly to keep a constant inlet pressure. The other mode is constant rate mode in which the subsea pump 108 maintains a constant flow rate in contrast to a constant inlet pressure.

Unlike in conventional drilling wherein all the energy required for moving drilling fluids around the wellbore 106 is from the mud pumps at the drilling vessel 102, the subsea pump 108 works together with surface mud pumps to circulate fluid. The ability to add energy to the drilling system 100 from the subsea pump 108 provides significant advantages. The added energy helps reduce the power requirement for surface mud pumps, which is often a limiting factor in drilling deep water wells. It also helps reduce the pressure loads on surface equipment and piping system. The subsea pump 108 acts like a booster or a relay in the drilling system 100. The amount of energy that can be added is fully controllable so that the pressure along the flow path can be accurately managed.

In certain exemplary embodiments, the drill string valve 116 is positioned in a lower section of the drill string 136 in the wellbore 106. In certain exemplary embodiments, the drill string valve 116 is positioned in the drill string 136 at any position between the subsea rotating device 110 and the drill bit 140. The drill string valve 116 is a pressure regulating check valve to prevent free fall of the drilling fluids in the drill string 136 when surface mud pumps stop or slow. The drill string 136 is full of drilling fluids from the drilling vessel 102 to the drill bit 140 at the bottom of the wellbore 106 during drilling. The annular spaces 150, 152, however, comprises the same density drilling fluids below the subsea rotating device 110 and a lighter riser fluid above in the riser annular space 128. The drill string valve 116 is open when the mud pumps are actively operating, and is closed to hold the heavy drilling fluids in the drill string 136 when the pumps stop pumping to prevent an air gap or a void space from forming in the drill string 136.

In certain exemplary embodiments, the drill string 136 passes through the center of the subsea rotating device 110. The subsea rotating device 110 is a sealing element that may be positioned at the bottom of the riser 126 or at any position within the riser 126. The subsea rotating device 110 seals the annular space 150 between the drill string 136 and the riser 126, while allowing the drill string 136 to rotate and reciprocate. The subsea rotating device 110 serves as a mechanical separation between the riser fluid and the drilling fluid. The seal prevents fluids carrying cuttings from moving up into the riser 126 as it does in conventional drilling. The subsea rotating device 110 assists with "managing" the wellbore 106 pressure in connection with the subsea pump 108 by trapping pressure and/or maintaining a pressure differential across its interface. Generally, the subsea rotating device 110 sits above the subsea pump 108, but may sit anywhere so long as the suction of the subsea pump 108 is situated below the subsea rotating device 110. The subsea rotating device 110 traps pressure below and separates it from the pressure above to keep the wellbore 106 overbalanced or dead during connections. The subsea rotating device 110 can also help remove pressure below and separates it from the pressure above to prevent the wellbore 106 from being fractured by the dynamic pressure while drilling. To drill a longer section, the total wellbore pressure while drilling (called "dynamic pressure" as drilling fluids are circulating) may be increased or decreased so that it stays within the operating pressure window. The total wellbore pressure while making connections (called "static pressure" as drilling fluids are not moving) must be maintained so that it does not fall below pore pressure. The formation pore pressure and fracture pressure change slightly or do not change in the lateral section because the rock weight above changes only slightly in the lateral direction. While drilling, subsea rotating device 110 allows for pressure below to be pumped off, either partially or fully compensating for the increase in pressure in the wellbore 106 due to fluids movement. This way, a lateral section 160 of the well can be drilled longer as dynamic pressure is reduced.

The drilling system 100 features dual gradient (density) fluids, that is, a lighter fluid 146 in the marine riser 126 (the "riser fluid") and a heavier fluid 144 in the wellbore 106 below the riser 126 (the "drilling fluids"). In certain exemplary embodiments, the riser fluid has a density of sea water, or close to that of sea water. The riser fluid remains static and does not ordinarily circulate during drilling. The drilling fluids density is determined such that the total hydrostatic pressure imposed by the two fluids (riser fluid on top of drilling fluid) plus the pressure trapped at the subsea rotating device 110 is slightly higher than the pore pressure in the formation in the lateral section at static conditions. The pressure that needs to be trapped at the subsea rotating device 110 depends on the frictional pressure at dynamic conditions. The pressure trapped at static conditions can be greater than, equal to, or less than the friction pressure that may be taken off at dynamic conditions, as needs demand. In certain exemplary embodiments, the pressure trapped at static conditions typically has the same magnitude as the amount of friction pressure that may be taken off at dynamic conditions. In certain other exemplary embodiments, the pressure trapped at static conditions is greater in magnitude than the amount of friction pressure that may be taken off at dynamic conditions.

At static conditions, the pressure at the sea floor 124 is increased to keep the wellbore 106 overbalanced. In certain exemplary embodiments, the pressure is increased by increasing the subsea pump 108 inlet pressure below the subsea rotating device 110. The total pressure below the subsea rotating device 110 is higher than above, by the same amount of the subsea pump 108 inlet pressure increase. At dynamic conditions (during drilling), when a pressure reduction in the wellbore 106 is required to reduce the effects of dynamic pressure, the subsea pump 108 may reduce the inlet pressure below the subsea rotating device 110 by opening the sea water discharge choke (not shown). The pressure above subsea rotating device 110 can remain the same. In certain exemplary embodiments, the pressure across the subsea rotating device 110 is generally balanced. The friction in the wellbore 106 plus the total hydrostatic pressure imposed by the two fluids keeps the well overbalanced. When a pressure increase in the wellbore 106 is required, the subsea pump 108 will increase inlet pressure below the subsea rotating device 110 by closing the sea water discharge choke.

The drilling system 100 is advantageous over conventional managed pressure drilling technology wherein back pressure must be introduced at the drilling vessel 102 at static conditions to keep the wellbore 106 overbalanced. A trapped pressure is applied at the subsea rotating device 110 instead of at drilling vessel 102 in the practice of the invention, which is very effective and efficient. In the event that the wellbore 106 becomes underbalanced during connections if the subsea rotating device 110 at sea floor 124 fails, the heavy drilling fluids from the wellbore 106 will go up into the riser 126 by tripping a bypass (not shown) and displace some light riser fluid out of the riser 126. The well could eventually reach a new equilibrium status when enough heavy drilling fluids are moved up into the riser 126. This is not achievable with the conventional managed pressure drilling because the seal device in managed pressure drilling operations is located at drilling vessel 102. In addition, the drilling system 100 poses less gas release risk than conventional drilling or conventional managed pressure drilling in that it is less likely for gas to enter the riser 126. The subsea rotating device 110 serves as an additional barrier near the sea floor 124 to prevent gas coming up to riser 126. There is no such a barrier in conventional drilling or conventional managed pressure drilling, and this is a further advantage of the invention.

The drilling system 100 has advantages over the dual gradient drilling technology that is known in the industry. The existing dual gradient technology also uses two different density fluids, a lighter fluid 146 in the riser 126 and a heavier fluid 144 in the wellbore 106. The two fluid gradients create a wellbore 106 pressure profile (pressure versus vertical depth) that better matches the earth pore pressure and fracture pressure profile. This match helps drill a longer open hole than conventional drilling technology in a vertical well, but it does not assist in a horizontal well. The drilling system 100 of this invention significantly increases the length of an open hole section that may be drilled horizontally. The length may be more than three times greater than conventional drilling systems.

One of the challenges in drilling deep water lateral wells is to maintain the wellbore pressure inside the narrow operating pressure window between formation pore pressure and fracture pressure. Too low of a pressure during connections induces formation fluid intrusion (also called "influx") and too high pressure during drilling results in lost returns of drilling fluids. A common practice in horizontal drilling is that all the wellbore sections above a heel 174 are cased off by casing strings. The start point of a lateral section is called "heel" while the end point (wellbore bottom) is called the "toe". At static conditions during connections, a pressure is trapped below the subsea rotating device 110. The pressure below the subsea rotating device 110 is higher than above by the amount of the trapped pressure. The wellbore "sees" the hydrostatic pressure from the two fluids plus the trapped pressure, and it is the same across a horizontal section since the vertical depth is the same. It will be slightly different in a non-horizontal lateral. The well is overbalanced. The formation is not fractured.

When drilling commences, drilling fluids circulation begins. Once the drilling fluids start to move, frictional pressure caused by fluid movement becomes relevant. The lateral section will "see" both the fluid hydrostatic pressure and the friction in the annulus between the drill string 136 and the wellbore 106. The friction along the lateral section is largest at a toe 170 and smallest at the heel 174, as drilling fluids in the annular space 152 moves from toe 170 to heel 174. The longer the lateral section, the higher the friction. Although the hydrostatic pressure stays the same, the total pressure at the toe 170 increases as drilling progresses due to increasing fluid frictional pressure from increase wellbore length in the lateral. If no pressure is taken off below the subsea rotating device 110 during drilling, the total pressure at the toe 170 may reach formation fracture pressure (rock strength) before the target wellbore length is reached. The drilling system 100 of the present invention, however, "takes off" the annular frictional pressure during drilling once drilling fluids start to circulate. It reduces the subsea pump 108 inlet pressure below the subsea rotating device 110 by as much as the amount of friction pressure at the heel 174 so that the pressure at the heel 174 is relatively constant at both static and dynamic conditions. The total pressure at the heel 174 does not increase as drilling progresses. The total pressure at the toe 170 does increase. However, the happening of toe pressure reaching the fracture pressure of the formation is delayed, thus it facilitates the extension and depth of the lateral section that can be drilled. In certain exemplary embodiments, the lateral section that can be drilled using the drilling system 100 is about 367% longer than the lateral section that can be drilled without using the techniques of the invention.

The maximum amount of friction that can be "taken off" at dynamic conditions is the friction pressure at the heel 174, if a minimum overbalance is selected at static conditions. If more friction is taken off, the pressure at the heel 174 will fall below pore pressure causing formation influx into the wellbore 106. In this scenario, all or part of the friction pressure at the heel 174 can be taken off. The maximum benefit is achieved if all of the heel friction pressure can be removed. Partial benefit can be achieved if part of the heel friction pressure is removed. The heel pressure can be maintained constant if all of the heel friction pressure is removed. In other words, the total wellbore 106 pressure can be controlled by managing the pressure at the heel 174.

Figure 2:
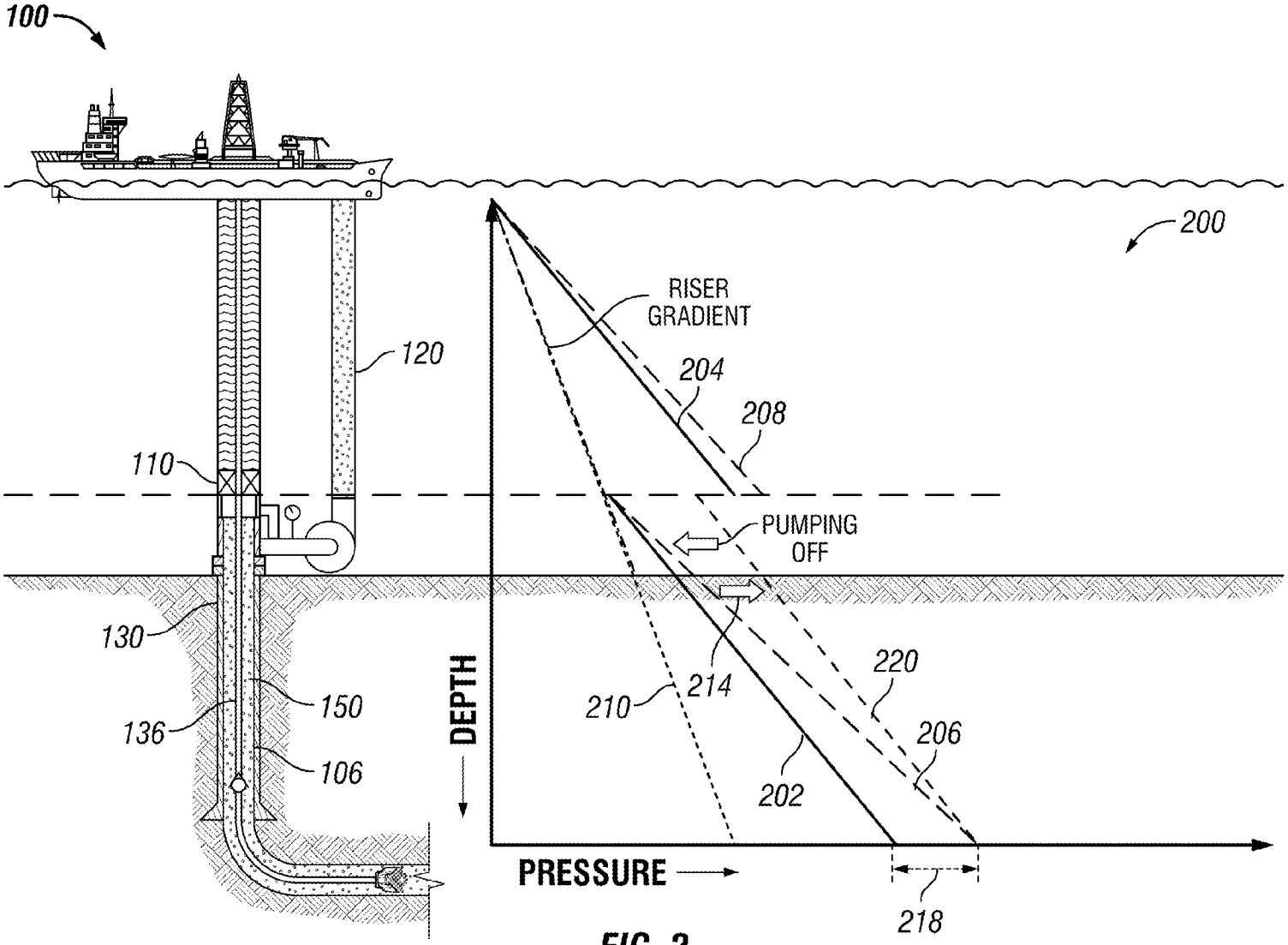
FIG. 2 is a graphical representation of the pressure profiles of the dual gradient drilling system of FIG. 1, according to an exemplary embodiment.

Referring now to FIG. 2, the graph 200 illustrates static pressure profiles 202, 204 and dynamic pressure profiles 206, 208 in the annular space 150 below the subsea rotating device 110 and within the mud return line 120 for the dual gradient drilling system 100. The pressure profiles 202, 204 illustrate when the fluid is static, while the pressure profiles 206, 208 represent dynamic fluid pressure, which includes frictional effects (annular friction pressure). The pressure profiles 202, 206 represent the pressure profiles in the annular space 150, and the pressure profiles 204, 208 represent the pressure profiles in the mud return line 120. In certain exemplary embodiments, the dual gradient drilling system 100 operates with a pressure profile 210 (riser gradient) at or slightly above seawater gradient immediately below the subsea rotating device 110. However, in the drilling system 100, the system can be operated to trap pressure 214 below the subsea rotating device 110 during the transition from dynamic to static conditions thereby increasing static pressure in the wellbore 106. The graph 200 shows a pressure 218 equivalent to annular friction pressure being trapped below the subsea rotating device 110 resulting in a static pressure profile 220. When fluid circulation commences, the pressure would be pumped off to negate the effects of the dynamic annular friction pressure. The perceived hole pressure at the hole bottom or heel 174 should fluctuate minimally thereby sustaining the pressure within the desired pressure window and reducing the effects of annular friction pressure. This is represented by the pressure-depth intersection of the dynamic annular pressure profile 206 and the static annular pressure with trapped annular friction pressure line 220.

Figure 3:
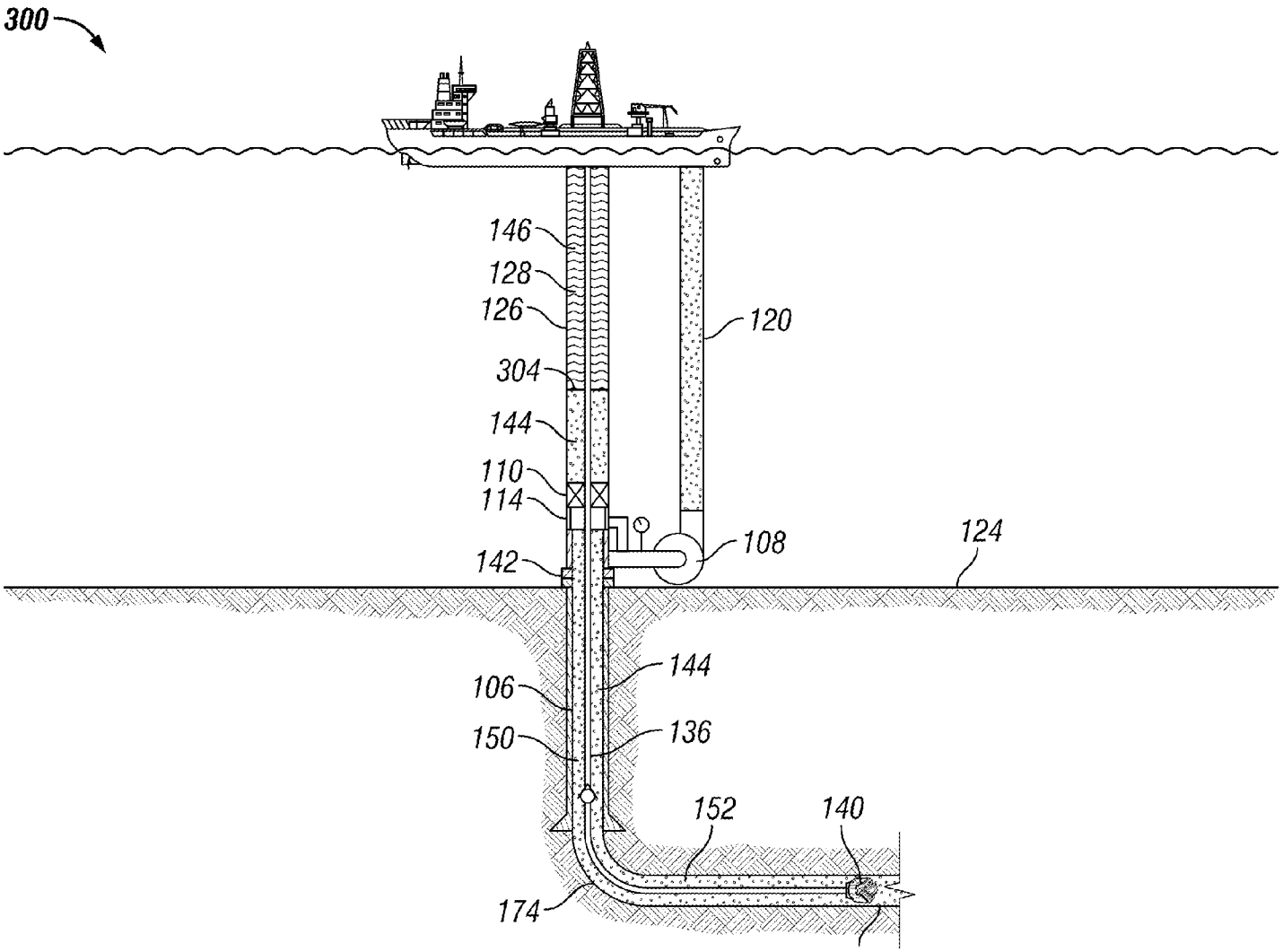
FIG. 3 is a schematic of a dual gradient drilling system, according to another exemplary embodiment.

FIG. 3 illustrates a drilling system 300 for managing pressure in a dual gradient drilling configuration for extended-reach or long horizontal well drilling, according to another exemplary embodiment. The drilling system 300 is the same as that described above with regard to drilling system 100, except as specifically stated below. For the sake of brevity, the similarities will not be repeated hereinbelow. Referring now to FIG. 3, it is possible to achieve the desired lateral length by taking off pressure below the subsea rotating device 110 at dynamic conditions, but not having to trap pressure at static conditions as in the drilling system 100. The drilling system 300 uses the same density riser fluid 146 and the same density drilling fluids or mud 144 as in the drilling system 100, but with a riser fluid/drilling fluids interface 304 higher at a predetermined location in the riser 126 instead of at the subsea rotating device 110. The hydrostatic pressure imposed by the two fluids stacked together is enough to keep the wellbore 106 overbalanced at static conditions so that there is no need to trap additional pressure at the sea floor 124. A major benefit is to allow the management of wellbore pressure while keeping the wellbore 106 hydrostatically dead at all times. The required location of interface 304 in the riser 126 is controlled by the magnitude of the annular friction pressure between the subsea rotating device 110 and the heel 174. The larger the pressure changes required at sea floor 124, the higher the interface 304 is located in the riser 126. The maximum pressure reduction achievable at the sea floor 124 is the difference between total hydrostatic pressure in the riser 126 (drilling fluids plus riser fluid) and the ambient sea water hydrostatic pressure at the subsea pump 108. Generally, the pressure across the subsea rotating device 110 is balanced at static conditions. At dynamic conditions (in drilling) when a pressure reduction in the wellbore 106 is required, the subsea pump 108 will reduce the inlet pressure below the subsea rotating device 110 by opening the sea water discharge choke (not shown). The pressure above the subsea rotating device 110 remains essentially the same. Upon opening the sea water discharge choke, there is a differential pressure across the subsea rotating device 110 pointing downward. When a pressure increase in the wellbore 106 is required, the subsea pump 108 will increase inlet pressure below the subsea rotating device 110 by closing the sea water discharge choke. A similar or greater lateral length can be drilled as with drilling system 100.

Figure 4:
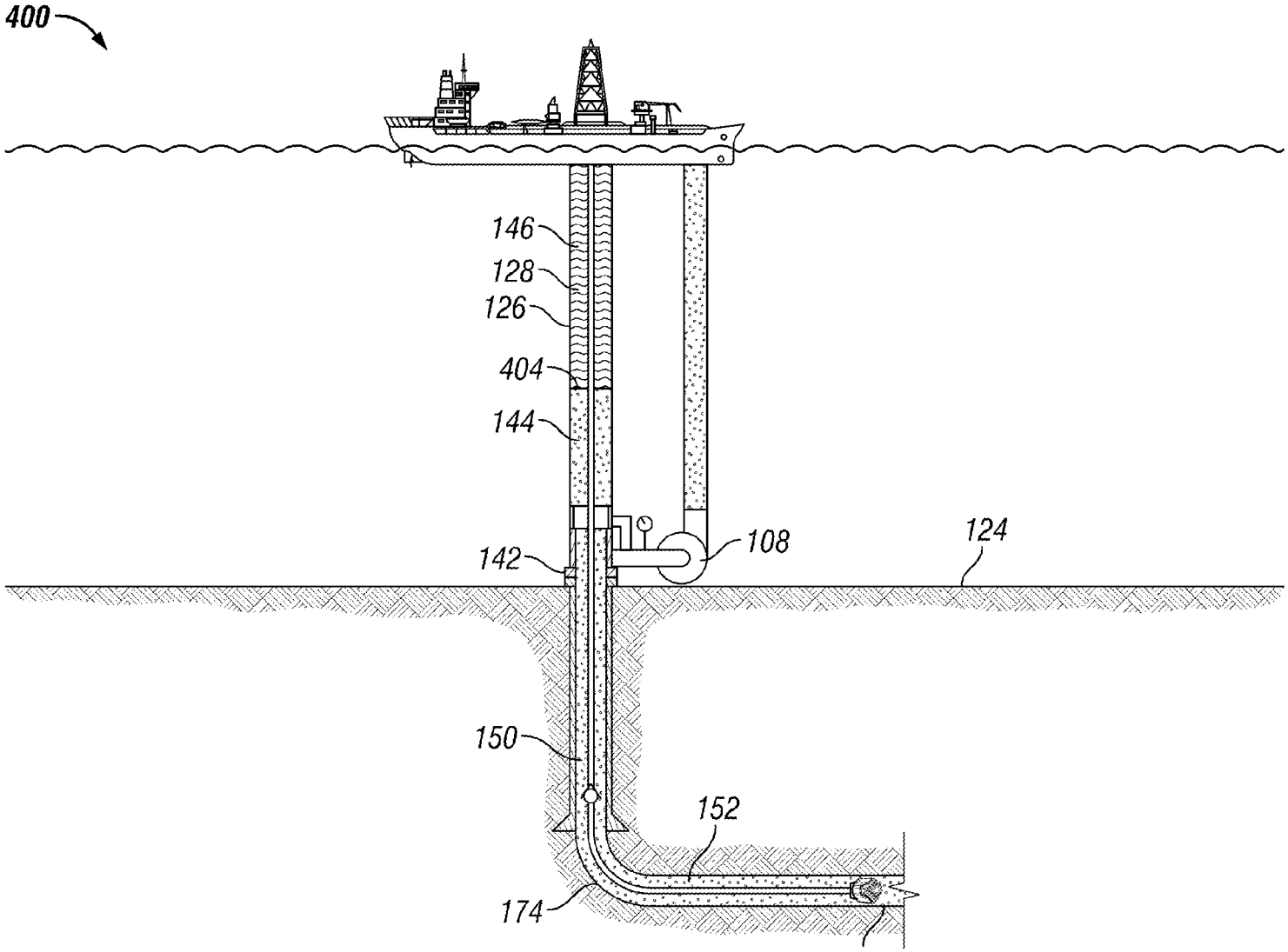
FIG. 4 is a schematic of a dual gradient drilling system, according to yet another exemplary embodiment.

FIG. 4 illustrates a drilling system 400 for managing pressure in a dual gradient drilling configuration for extended-reach or long horizontal well drilling, according to yet another exemplary embodiment. The drilling system 400 is the same as that described above with regard to drilling system 300, except as specifically stated below. For the sake of brevity, the similarities will not be repeated hereinbelow. The drilling system 400 does not include the subsea rotating device 110, but rather employs a drilling fluids/riser fluid interface 404 that changes at different conditions. In certain exemplary embodiments, there are heavier drilling fluids 144 in the riser annular space 128 of only the lower portion of the riser 126 extending from the well head 142 upwards for a predetermined distance as in the drilling system 300. Above the heavier drilling fluids 144 in the riser annular space 128 is a lighter density fluid 146. At static conditions during connections, the interface 404 is at the same location as in the drilling system 300 so that the two fluids generate the same amount of hydrostatic pressure to balance pore pressure. At dynamic conditions during drilling, the interface 404 in the riser 126 will drop to a lower level, as there is no sealing device in place when the subsea pump 108 is pumping off pressure at the sea floor 124. In the drilling system 400, the interface 404 will drop to such a level that the total wellbore pressure (friction plus hydrostatic pressure from drilling fluids and riser fluid) is the same as in drilling system 100. The riser 126 is full of fluids at all times. Only the location of the fluid interface 404 changes over time.

Figure 5:
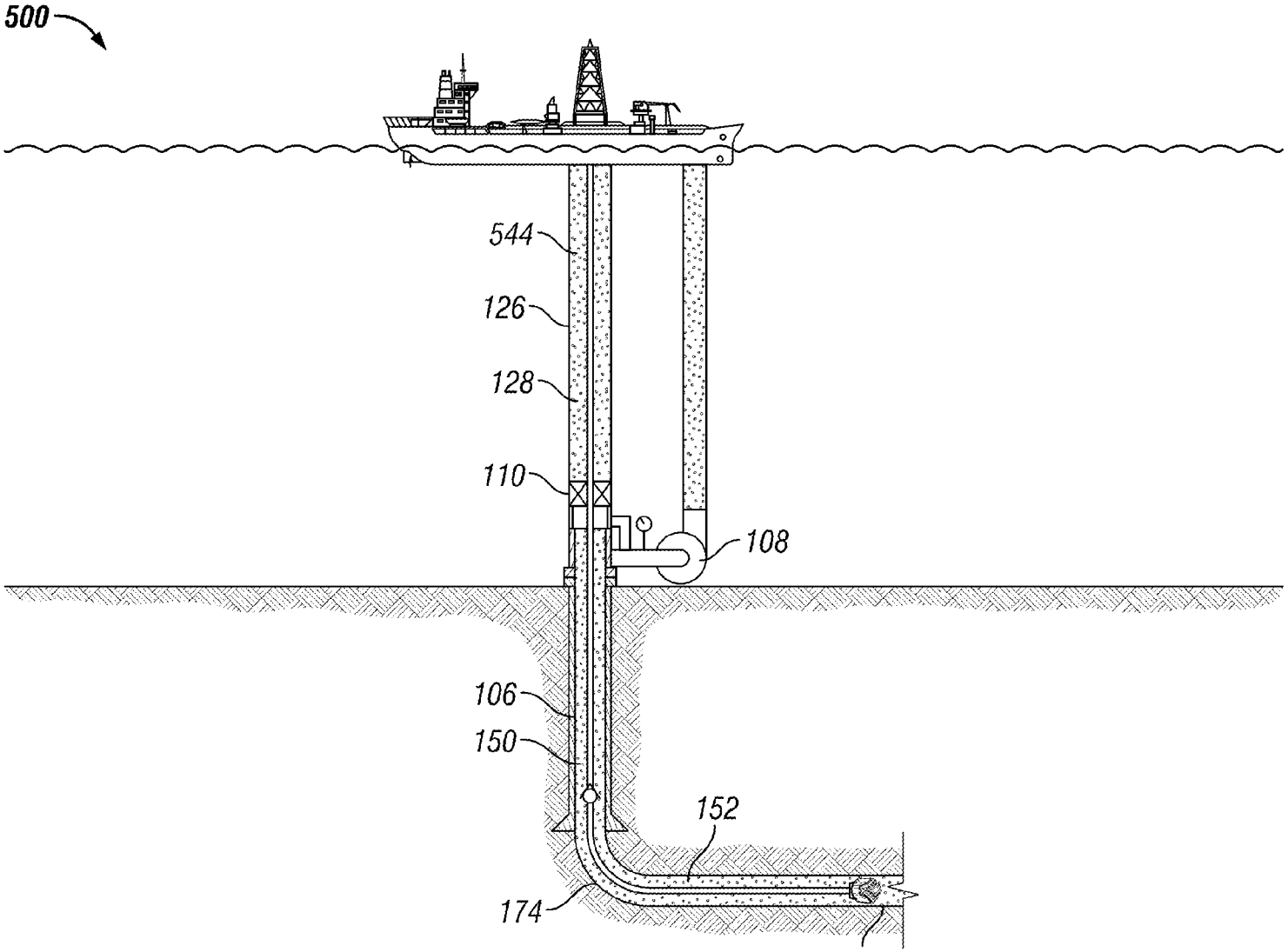
FIG. 5 is a schematic of a single gradient drilling system, according to an exemplary embodiment.

FIG. 5 illustrates a drilling system 500 for managing pressure in a single gradient drilling configuration for extended-reach or long horizontal well drilling, according to an exemplary embodiment. The drilling system 500 is the same as that described above with regard to drilling system 100, except as specifically stated below. For the sake of brevity, the similarities will not be repeated hereinbelow. Rather than using two fluids having different densities, the drilling system 500 employs the use of a one fluid 544 having a single density in the riser annular space 128 of the riser 126 from the bottom of the riser 126 to the top of the riser 126. In certain exemplary embodiments, a well is drilled with conventional relatively heavy drilling fluid in the riser annulus 128. However, unlike conventional managed pressure drilling, the wellbore 106 is hydrostatically "dead" while making connections as well as during drilling. The subsea pump 108 can "take off" or "pump off" pressure below the subsea rotating device 110, which enables a longer reach into the oil and gas producing formation.

Figure 6:
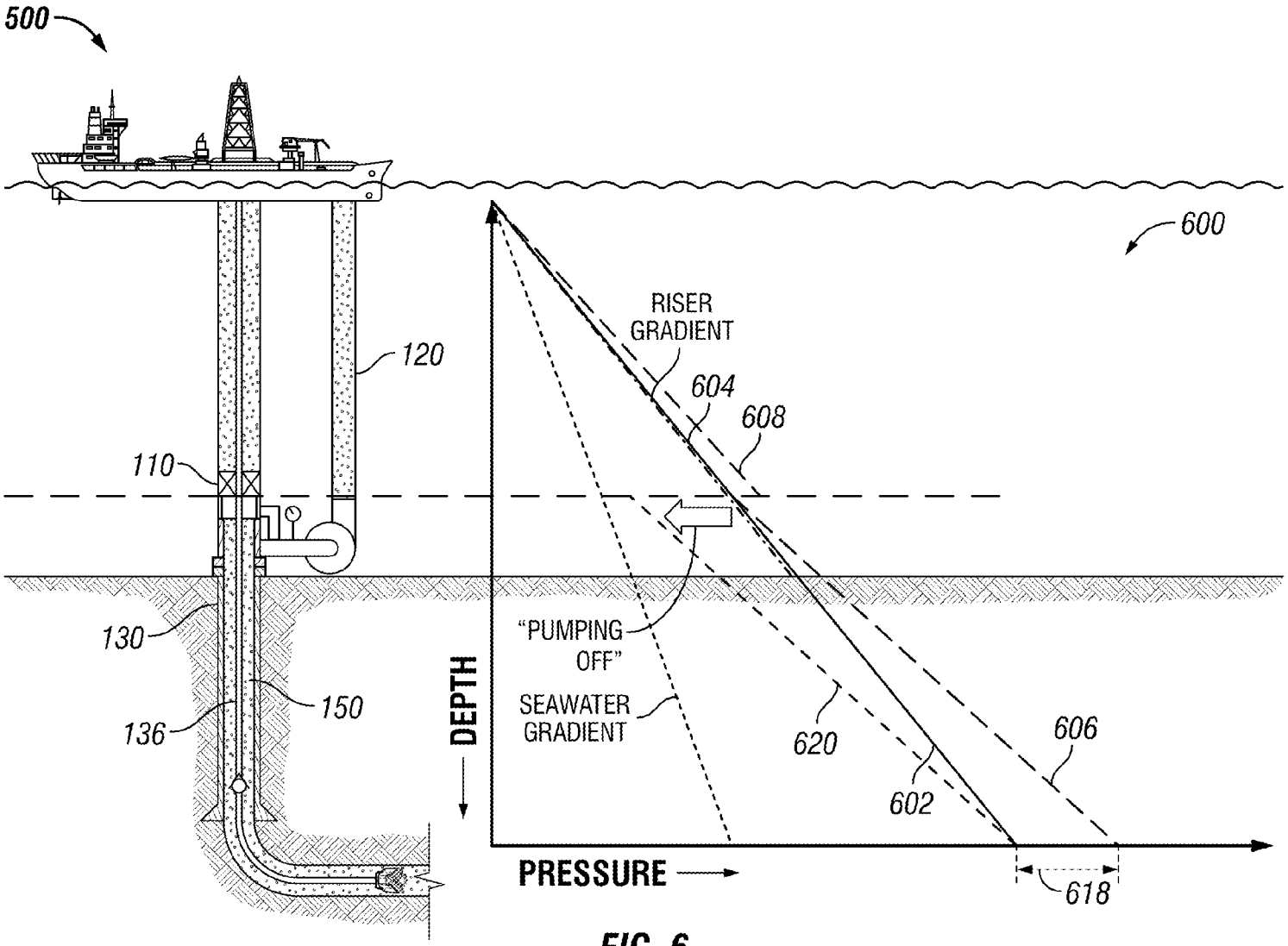
FIG. 6 is a graphical representation of the pressure profiles of the single gradient drilling system of FIG. 5, according to an exemplary embodiment.

Referring now to FIG. 6, the graph 600 illustrates a static pressure profiles 602, 604 and dynamic pressure profiles 606, 608 in the annulus 150 below the subsea rotating device 110 and within the mud return line 120 for the single gradient drilling system 500. The pressure profiles 602, 604 represent the static fluid gradient for the single fluid. The pressure profile 602 is the riser gradient. The dynamic pressure profile 606 includes the frictional effects (annular friction pressure 618). However, during circulation the drilling system 500 can be operated to pump-off pressure below the subsea rotating device 110 to a maximum value at or above the ambient seawater gradient 624 (or value of the annular friction pressure 618 at the heel). In certain exemplary embodiments, a pressure equivalent to the annular friction pressure 618 during circulation is pumped. The perceived hole pressure at the hole bottom or heel 174 should stay constant or fluctuate minimally thereby sustaining the pressure within the desired pressure window and minimizing the effects of annular friction pressure. This is represented by the pressure-depth intersection of the dynamic annular pressure with "pump off" 620 and the static annular pressure 602.

Figure 7:
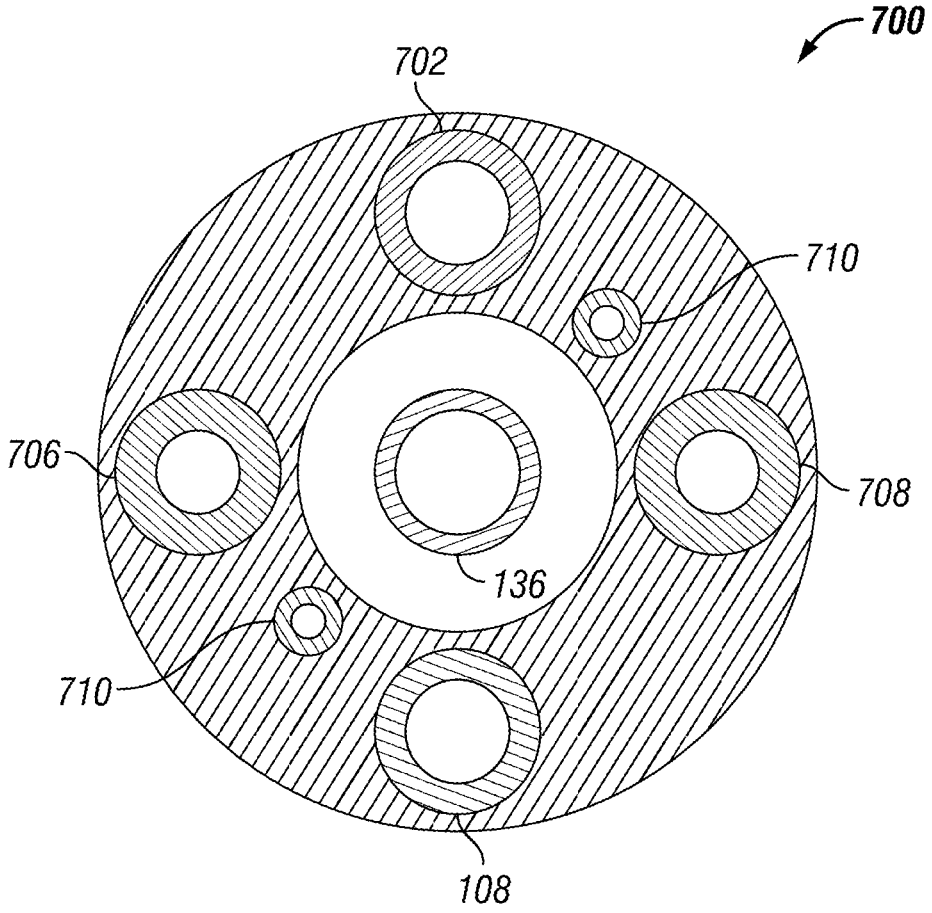
FIG. 7 is a cross-sectional view of a marine riser, according to an exemplary embodiment.

FIG. 7 is a cross-sectional view of a marine riser 700, according to an exemplary embodiment. The riser 700 is the same as that described above with regard to riser 126, except as specifically stated below. For the sake of brevity, the similarities will not be repeated hereinbelow. The riser 700 includes a drill string 136 positioned generally in a center thereof through which drilling fluids are pumped down. The riser 700 also includes a seawater power line 702 for transmission of filtered seawater to the subsea pump 108. The mud return line 120 may also run through the riser 700. In certain exemplary embodiments, the seawater power line 702 and the mud return line 120 have an internal diameter of about six inches. In certain exemplary embodiments, the riser 700 includes 15,000 pounds per square inch (15K) choke line 706 and kill line 708 for circulating fluids to the subsea blowout preventer. The riser 700 further includes two hydraulic lines 710 for the provision of power control fluid to the subsea systems. In certain exemplary embodiments, the riser 700 has a 3.5 million pounds (MM lb) flange rating.

Generally, the present invention is directed to drilling systems that reduce pressure below the subsea rotating device during drilling to increase lateral, pay-zone wellbore length while staying below the fracture pressure. In addition, the invention as disclosed herein may adjust the pressure in real time to keep the wellbore pressure constant at a given depth while the drilling is stopped, started, stopped, started, repeatedly—when drilling changes from static to dynamic conditions. By keeping the wellbore pressure constant at a certain given depth, the systems of the present invention make it possible to "stay within the pressure window" for a longer period of time, extending horizontal reach of drilling into the hydrocarbon bearing pay-zone. The drilling systems of the present invention can maintain constant wellbore pressure at a given depth below the mudline during oscillation from static to dynamic conditions during drilling. In addition, when compared to conventional drilling, or known managed pressure drilling techniques, the drilling systems of the invention may, in some cases, significantly increase the length of a lateral section that may be drilled through hydrocarbon-filled pay zones to improve the oil and gas production rate of the drilled well.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. While numerous changes may be made by those skilled in the art, such changes are encompassed within the spirit of this invention as defined by the appended claims. For instance, various gradients of fluids can be utilized in the systems of the present invention, including, but not limited to, seawater, seawater gradient mud, heavy mud, and fluids having gradients above seawater and below heavy mud. In the embodiments described herein, any weight of fluid can be utilized above the riser fluid-drilling fluid interface, including heavy mud. In certain embodiments, multiple fluids can be utilized, each having a different gradient. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. The terms in the claims have their plain, ordinary meaning unless otherwise explicitly and clearly defined by the patentee.

What is claimed is:

1. A method for drilling a subsea well from a rig through a subsea wellhead below the rig, the method comprising:

(a) providing a drill string having drilling fluid therein, the drill string extending from the rig into the well;

(b) providing a surface mud pump positioned adjacent the rig, the surface mud pump configured for conducting drilling fluid through the drill string from the rig to a drill bit in the well and operating at a surface mud pump rate;

(c) providing a riser for internally receiving the drill string such that a riser annulus is defined between the drill string and the riser, wherein the riser has one end coupled to the rig and another end coupled to a subsea rotating device located in the riser for sealing the riser annulus and separating a riser fluid above the subsea rotating device and the drilling fluid below the subsea rotating device;

(d) providing the well annulus on the exterior of the drill string, the well annulus extending from the bottom of the well to the subsea rotating device;

(e) providing the subsea rotating device, wherein the well annulus is isolated from the riser annulus by the subsea rotating device such that the pressure in the well annulus is isolated from the pressure in the riser annulus;

(f) providing a subsea pump located below the subsea rotating device, the subsea pump having an inlet adapted to receive drilling fluid emerging from the well and operating at a subsea pump rate;

wherein during times of drilling, the surface mud pump adjacent the rig delivers drilling fluid into the well, resulting in a dynamic bottom hole pressure;

and during times that drilling is not occurring, the surface mud pump adjacent the rig is not delivering drilling fluid into the well, resulting in a static bottom hole pressure, the static bottom hole pressure being less than the dynamic bottom hole pressure;

wherein the surface mud pump and the subsea pump operate together to circulate drilling fluid in the drill string in the well; and (g) selectively decreasing pressure below the subsea rotating device by increasing the subsea pump rate relative to the surface mud pump rate thereby achieving a desired pressure reduction in the well annulus below the subsea rotating device.

2. The method of claim 1, wherein the surface mud pump rate and the subsea pump rate are increased, further wherein the increase in subsea pump rate is at a proportionally greater rate than the increase in the surface mud pump rate, thereby pumping off pressure below the subsea rotating device until a desired pressure reduction is achieved in the well annulus below the subsea rotating device.

3. The method of claim 1, further comprising selectively trapping pressure in the well annulus below the subsea rotating device by reducing the subsea pump rate relative to the surface mud pump rate.

4. The method of claim 3, wherein the pressure is trapped during static intervals, followed by removal of the trapped pressure in the well annulus during subsequent dynamic intervals.

5. The method of claim 3, wherein pressure is increased below the subsea rotating device by maintaining or reducing the surface mud pump rate while reducing the subsea pump rate to a proportionally lower rate than the surface mud pump rate, until a desired pressure is trapped in the well annulus below the subsea rotating device.

6. The method of claim 1, wherein the surface mud pump rate is coordinated with the subsea pump rate, thereby facilitating pressure control of the pressure in the well annulus below the subsea rotating device.

7. The method of claim 1, further comprising providing a solids processing unit adapted to reduce the size of cuttings contained in returning drilling fluid and conduct returning drilling fluid away from the well annulus.

8. The method of claim 7, further comprising providing a return line for conducting drilling fluid from the solids processing unit to the surface mud pump, wherein the subsea pump has an inlet operably coupled to the solids processing unit and an outlet operably coupled to the return line.

9. The method of the claim 1, wherein the subsea well is a horizontal well having a heel; wherein achieving the desired pressure reduction in the well annulus below the subsea rotating device comprises a pressure reduction at the heel thereby facilitating drilling of a lateral section of the well to a greater length than would be possible without the pressure reduction without fracturing the well.

10. The method of the claim 1, wherein the subsea well is a horizontal well having a heel; wherein pressure at the heel is controlled during drilling of the well thereby facilitating drilling of a lateral section of the well to a greater length than would be possible without the pressure control without fracturing the well.

11. The method of claim 1, further comprising providing a check valve positioned within an inner diameter of the drill string in the well located around the subsea rotating device configured to close when the surface mud pump stops or slows thereby preventing free fall of the drilling fluid in the drill string and providing isolation between the subsea pump and surface mud pump during times that drilling fluid flow is static.

12. The method of claim 1, wherein the subsea well is a horizontal well; and wherein achieving the desired pressure reduction in the well annulus below the subsea rotating device offsets risk of wellbore fracture resulting from pressure difference between the dynamic bottom hole pressure and the static bottom hole pressure.

13. The method of claim 1, wherein the subsea pump is located at or near a sea floor.

14. The method of claim 1, wherein the subsea pump rate is controlled to achieve a pump inlet pressure specified by a user and monitored by at least one pressure transducer on the subsea pump.

15. The method of claim 1, further comprising during times of drilling, the surface mud pump adjacent the rig delivers drilling fluid into the well at a rate which is increasing without resulting in an increase in bottom hole pressure.

16. The method of claim 1, wherein the subsea well has a pore pressure; and wherein during times that drilling is not occurring, selectively decreasing pressure below the subsea rotating device by increasing the subsea pump rate relative to the surface mud pump rate thereby achieving a desired pressure reduction in the well annulus below the subsea rotating device to a pressure below the static bottom hole pressure and not less than the pore pressure.

* * * * *